US006167659B1

(12) United States Patent
Swindell, III

(10) Patent No.: US 6,167,659 B1
(45) Date of Patent: Jan. 2, 2001

(54) ROOF OR ACCESS HATCH SAFETY RAILING SYSTEM

(75) Inventor: Harold L. Swindell, III, Mt. Laurel, NJ (US)

(73) Assignee: Nesea Construction, Incorporated, Mt. Laurel, NJ (US)

( * ) Notice: Under 35 U.S.C. 154(b), the term of this patent shall be extended for 0 days.

(21) Appl. No.: 09/243,869

(22) Filed: Feb. 3, 1999

(51) Int. Cl.[7] ..... E04B 7/18

(52) U.S. Cl. ..... 52/20; 52/200; 182/106; 182/113

(58) Field of Search ..... 52/20, 200; 182/106, 182/112, 113

(56) References Cited

U.S. PATENT DOCUMENTS 2,572,281 10/1951 Pierce .
3,598,200 8/1971 Thompson .
3,858,905 * 1/1975 Peebles ..... 182/106 X
4,418,792 12/1983 Cerone .
4,509,617 4/1985 Lapeyre .
4,546,855 10/1985 Lyons .
5,931,258 * 8/1999 Lorentz ..... 182/106 X
6,053,281 * 4/2000 Murray ..... 182/113

* cited by examiner

*Primary Examiner*—Christopher T. Kent
(74) *Attorney, Agent, or Firm*—Norman E. Lehrer

(57) ABSTRACT

A roof hatch safety railing for increasing a person's safety as he or she climbs onto a roof or platform of a building from a roof or access hatch is disclosed. The safety railing includes two poles where one pole is attached to the right side of a roof hatch and the other pole is attached to the left side of the hatch. A person may grab the poles as he or she climbs from the roof or access hatch ladder, through the hatch, and onto the roof or platform. The poles are also spaced away from the hatch, thereby allowing enough clearance for a lid of the hatch to close and cover the hatch. The railing may be modified to accommodate various types and sizes of roof or access hatches.

16 Claims, 3 Drawing Sheets

116
112
118

124
174b
174a
140
160
142
138
166
122
126
174d
174e
114
156
136
174c
120
134
132
176e
176d
152
176c
130
176a
146
164
144
150
176b
148
128
154
168
158

ROOF OR ACCESS HATCH SAFETY RAILING SYSTEM

BACKGROUND OF THE INVENTION

The present invention is directed toward a safety railing and more particularly, toward a railing which is attached to an access hatch such as a roof access hatch in order to allow a person to climb safely onto a roof or platform from a roof hatch ladder.

Falls are a major cause of injuries in the workplace. In particular, falls from roof or access hatch ladders often result in permanent injury or death. In light of these safety hazards, OSHA now requires roof hatch safety railings. However, railings for attachment to roof hatches are virtually non-existent. Railings in other settings are well known. There remains a need for safety railings for access hatches and particularly, for roof hatches.

U.S. Pat. No. 4,546,855 to Lyons discloses a safety extension that can be mounted to the inside of a passageway which has an opening. A ladder extends through the passageway and is mounted to a wall of the passageway. The safety extension includes a rod received in a sleeve. The sleeve may be attached to the ladder or to a wall of the passageway. The safety extension may be used in manholes or hatchways and is grasped by a person when entering or exiting the passageway. This safety extension must be engaged before each use in order to be functional. Furthermore, this safety extension does not meet the requirements for roof hatch safety railings set forth by OSHA.

U.S. Pat. No. 3,598,200 to Thompson discloses a sleeve attached to the rungs of a manhole ladder. The sleeve has a slidable rod therein which is extendable from the manhole. The rod acts as a vertical railing or guide for the worker on the ladder. This type of railing would not be suitable for use with a roof hatch ladder. Also, this type of railing does not conform with the current OSHA standards.

SUMMARY OF THE INVENTION

The present invention is designed to overcome the deficiencies of the prior art discussed above. It is an object of the present invention to provide a safety railing which increases a person's safety when he or she is climbing from a stationary ladder to a platform through an access hatch.

It is another object of the railing of the present invention to act as an extension of a ladder leading to a roof or access hatch.

It is a further object of the invention to provide a safety railing which is easily and permanently attached to an existing roof hatch.

In accordance with the illustrative embodiments demonstrating features and advantages of the present invention, there is provided a roof or access hatch safety railing for increasing a person's safety as he or she climbs onto the roof or other platform of a building from an access or roof hatch. The safety railing includes one or more poles where one pole is attached to the right side of a roof or access hatch and the other pole is attached to the left side of the roof hatch. A person may grab onto the poles as he or she climbs from the roof hatch ladder, through the hatch, and onto the roof or platform. The poles are also spaced away from the hatch, thereby allowing enough clearance for a lid of the hatch to close and cover the hatch. The railing may be modified to accommodate various types and sizes of roof or access hatches.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
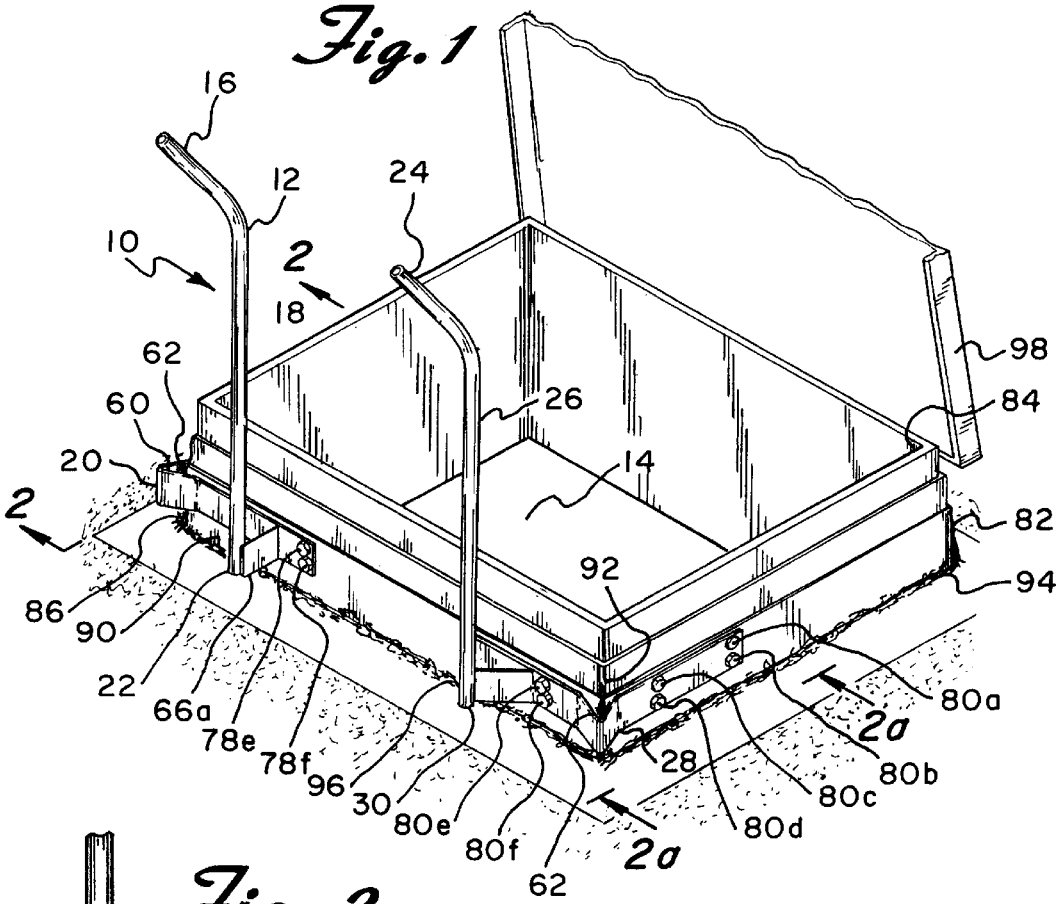
FIG. 1 is a perspective view of the railing of the present invention attached to a roof hatch.

Referring now to the drawings in detail wherein like reference numerals have been used throughout the various figures to designate like elements, there is shown in FIG. 1 a roof hatch safety railing constructed in accordance with the principles of the present invention and designated generally as 10. It must be understood that a roof hatch is being shown as the preferred embodiment. The invention is applicable to substantially any access hatch which allows a person to gain access to a roof, attic or other floor or substantially any horizontal support surface from below.

In the first embodiment of the present invention, the roof hatch safety railing essentially includes a right-handed pole 12 and a left-handed pole 14. (While in the preferred embodiment two poles are described, it should be realized that one pole may also be used.) Right-handed pole 12 has a curved handle 16, an elongated vertical section 18 extending from the handle 16, and a bracket 20 attached to the lowermost end 22 of the vertical section 18. Likewise, left-handed pole 14 has a curved handle 24, an elongated vertical section 26 extending from the handle 24, and a bracket 28 attached to the lowermost end 30 of the vertical section 26. Brackets 20 and 28 are attached or mounted to vertical sections 18 and 26, respectively, by any means known in the art, for example, by welding. Poles 12 and 14 may be formed from steel, fiberglass, or any material of comparable strength.

Figure 2:
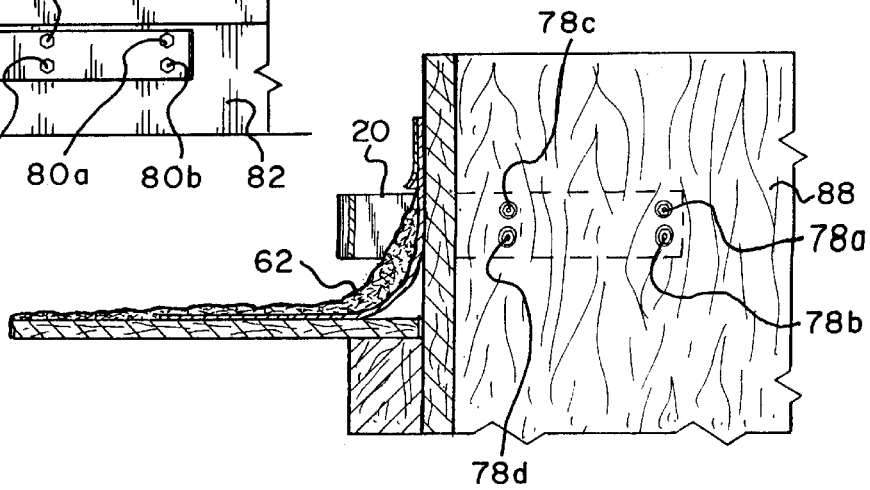
FIG. 2 is partial cross-sectional view of the present invention taken along line 2—2 of FIG. 1.
Figure 3:
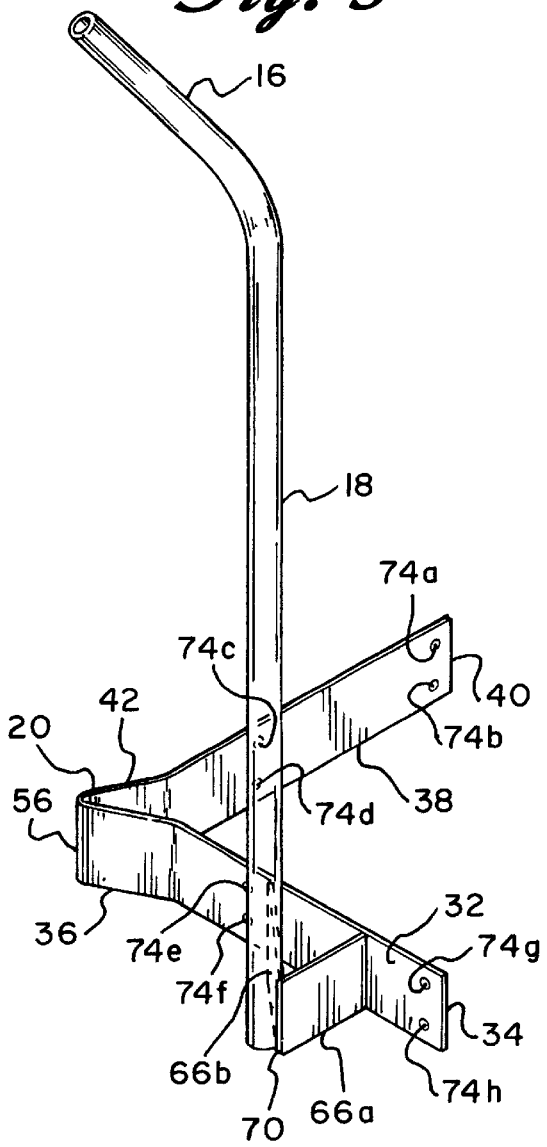
FIG. 3 is a perspective view of the right-handed pole of the railing of the present invention.
Figure 4:
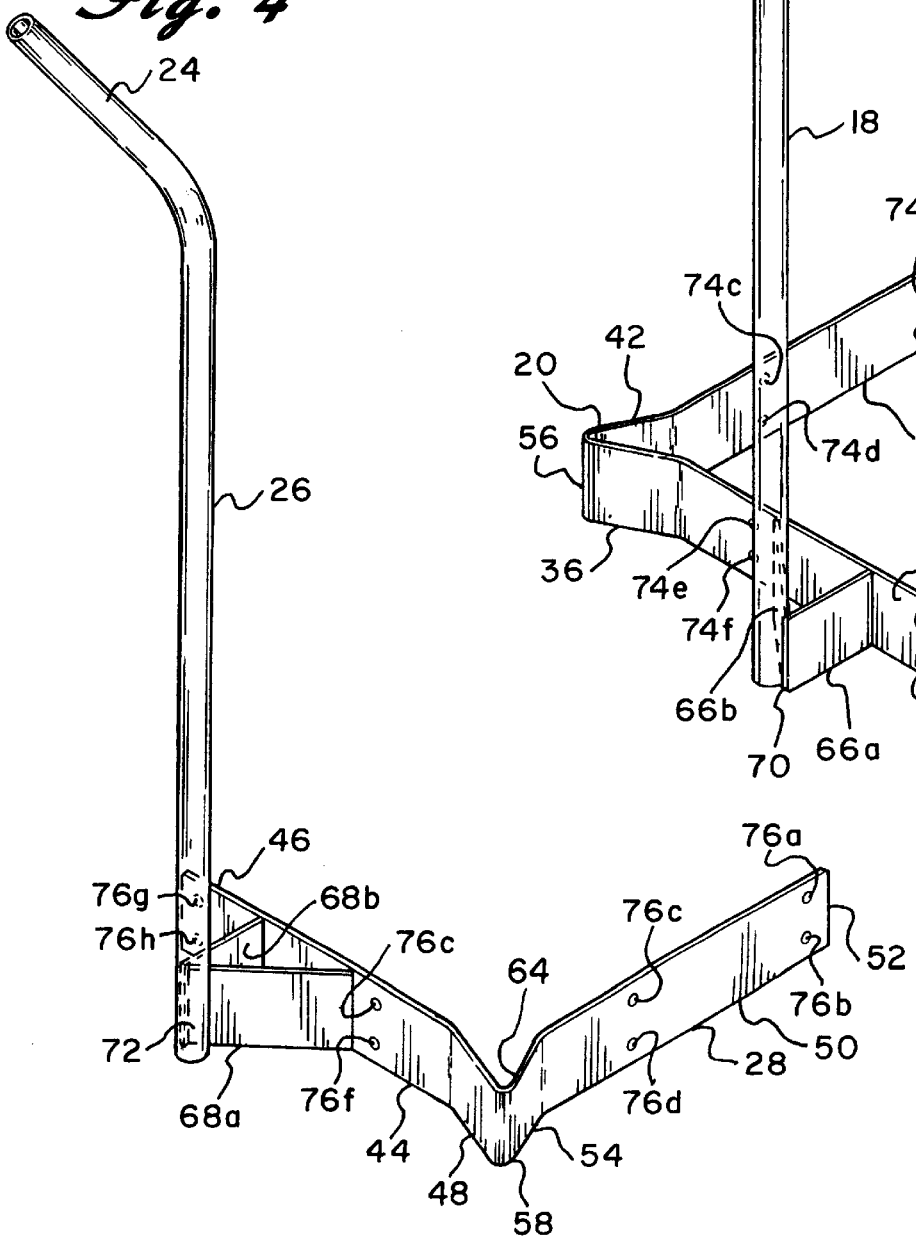
FIG. 4 is a perspective view of the left-handed pole of the railing of the present invention.

Right-handed bracket 20 is formed in a substantially L-shape with an elongated lateral leg 32 having a first end 34 and a second end 36 and an elongated, outwardly extending longitudinal leg 38 having a first end 40 and a second end 42 at a right angle to leg 32. (See FIG. 3.) Left-handed bracket 28 is formed in a substantially backwards L-shape with an elongated lateral leg 44 having a first end 46 and a second end 48 and an elongated, outwardly extending longitudinal leg 50 with a first end 52 and a second end 54. (See FIG. 4.) The junction 56 of lateral leg 32 and longitudinal leg 38 of right-handed bracket 20 and the junction 58 of lateral leg 44 and longitudinal leg 50 of left-handed bracket 28, however, do not form perfect ninety degree corners, respectively. That is, second end 36 of lateral leg 32 and second end 42 of longitudinal leg 38 of right-handed bracket 20 are slightly bent outwardly so that a space 60 is created in order to accommodate any excess roofing material or bulging 62, such as, caulking or metal stripping, which is usually found in the corners of roof hatches. (See FIG. 2.) Likewise, second end 48 of lateral leg 44 and second end 54 of longitudinal leg 50 of left-handed bracket 28 are slightly bent outwardly so that a space 64 is created.

Mounted near first end 34 of lateral leg 32 of right-handed bracket 20 are two extension flanges 66*a* and 66*b* which form a triangle with lateral leg 32 of right-handed bracket 20. Similarly, mounted near first end 46 of lateral leg 44 of left-handed bracket 28 are two extension flanges 68*a* and 68*b* which form a triangle with lateral leg 44 of left-handed bracket 20. Vertical section 18 of right-handed pole 12 is attached to the lateral leg 32 of right-handed bracket 20 at the junction 70 (or apex of the triangle) of extension flanges 66*a* and 66*b* and vertical section 26 of left-handed pole 14 is attached to lateral leg 44 of left-handed bracket 28 at the junction 72 of extension flanges 68*a* and 68*b*. (See, for example, FIG. 4.) Also, right-handed bracket 20 has holes 74*a*–74*h* and left-handed bracket 28 has holes 76*a*–76*h*, for example, through which bolts 78*a*–78*f* and bolts 80*a*–80*f* may be inserted, respectively, in order to secure the poles 12 and 14 to base member 82 of roof hatch 84, as will be described in more detail below. As can be clearly seen in the Figures, base member 82 extends upwardly from the level of the roof or other horizontal support surface.

In the second embodiment of the present invention the roof hatch safety railing essentially includes a right-handed pole 112 and a left-handed pole 114. Right-handed pole 112 has a curved handle 116, an elongated vertical section 118 extending from the handle 116, and a bracket 120 attached to the lowermost end 122 of the vertical section 118. Likewise, left-handed pole 114 has a curved handle 124, an elongated vertical section 126 extending from the handle 124, and a bracket 128 attached to the lowermost end 130 of the vertical section 126. As in the first embodiment, brackets 120 and 128 are attached or mounted to vertical sections 118 and 126, respectively, by any means known in the art, for example, by welding. Poles 112 and 114 may be formed from steel or material of comparable strength.

Figures 5, 6:
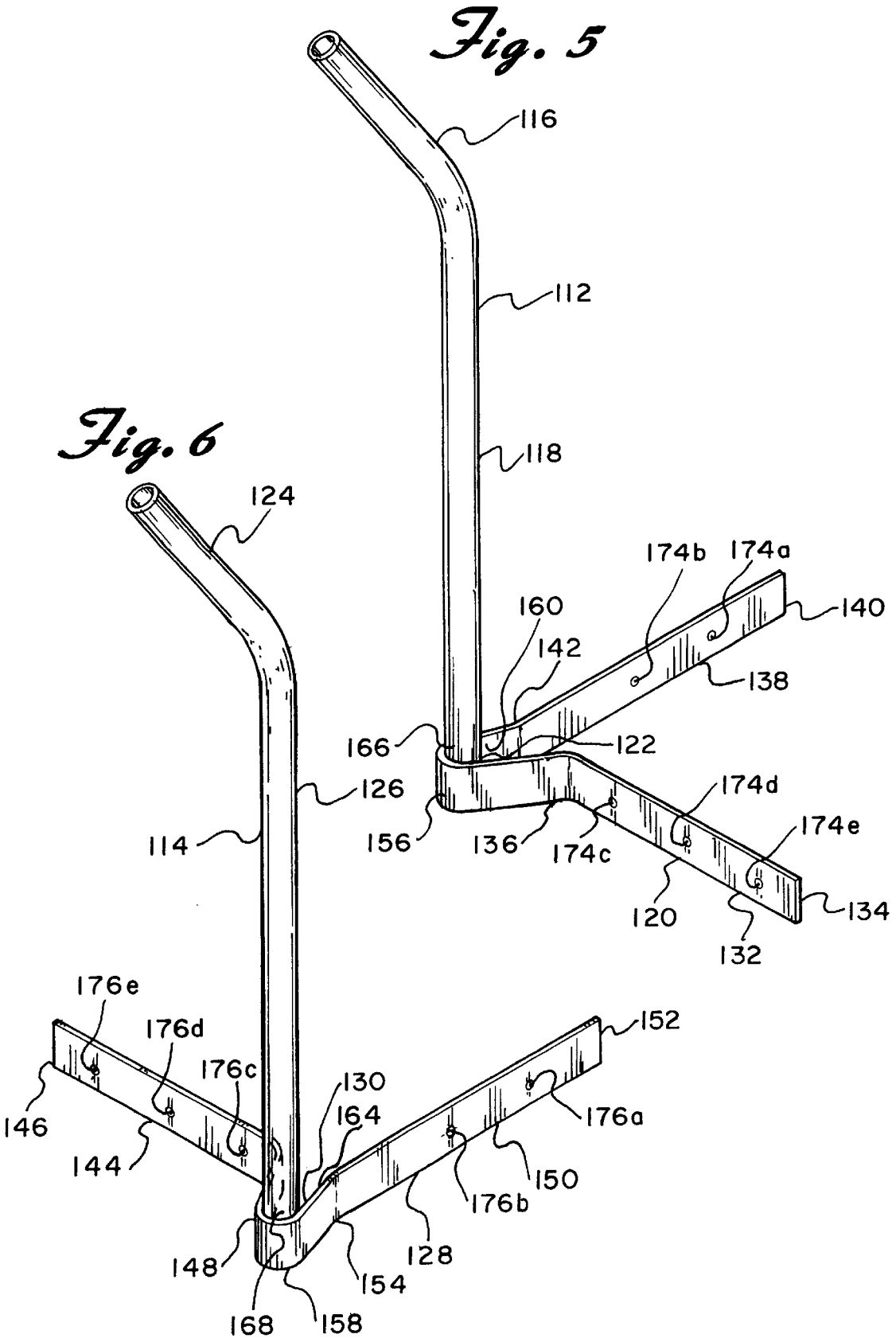
FIG. 5 is a perspective view of the right-handed pole of a second embodiment of the present invention.
FIG. 6 is a perspective view of the left-handed pole of a second embodiment of the present invention.

Right-handed bracket 120 is formed in a substantially L-shape with an elongated lateral leg 132 having a first end 134 and a second end 136 and an elongated, outwardly extending longitudinal leg 138 having a first end 140 and a second end 142, at a right angle to leg 132. (See FIG. 5.) Left-handed bracket 128 is formed in a substantially backwards L-shape with an elongated lateral leg 144 having a first end 146 and a second end 148 and an elongated, outwardly extending longitudinal leg 150 having a first end 152 and a second end 154. (See FIG. 6.) The junction 156 of the lateral leg 132 and longitudinal leg 138 of bracket 120 and the junction 158 lateral leg 144 and longitudinal leg 150 of bracket 128, again, do not form perfect ninety degree corners, respectively, rather, the corners are curved. That is, second end 136 of lateral leg 132 and second end 142 of longitudinal leg 138 of bracket 120 are slightly curved outwardly so that a space 160 is created in order to accommodate any excess roofing material or bulging as in the first embodiment. Likewise, second end 148 of lateral leg 144 and second end 154 of longitudinal leg 150 of bracket 128 are slightly curved outwardly so that a space 164 is created.

In this embodiment, unlike the first embodiment, vertical section 118 of pole 112 is attached at the inside junction 166 of the lateral leg 132 and longitudinal leg 138 of bracket 120 and vertical section 126 of pole 114 is attached at the inside junction 168 of the lateral leg 144 and longitudinal leg 150 of bracket 128. Bracket 120 has holes 174*a*–174*e* and bracket 128 has holes 176*a*–176*e*, for example, whereby bolts may be inserted therein in order to secure the poles 112 and 114 to the base member of a roof hatch. The purpose of placing vertical sections 118 and 126 of poles 112 and 114, respectively, at the junctions 166 and 168, respectively, is to accommodate smaller roof hatches and to meet OSHA requirements, as will be discussed in greater detail below. Furthermore, by placing the poles at the junctions, the lid of a roof hatch has enough clearance to close, thereby covering the hatch.

In order to describe the method of installing the safety railing of the present invention, the first embodiment will be used to illustrate. It should be noted, however, that the method of installation is the same for both embodiments.

Right-handed pole 12 is positioned on the right corner 86 of the base member 82 of the roof or access hatch 84 so that the longitudinal leg 38 of bracket 20 is positioned against the right side 88 of base member 82 of the roof hatch 84 and the lateral leg 32 of bracket 20 is positioned against the right front 90 of the base member 82 of roof hatch 84. (See FIG. 1.) Bolts 78*a*–78*f* are inserted into holes 74*a*–74*f*, respectively, and are used to fasten the bracket 20 to the base member 82 of the roof hatch 84. The left-handed pole 14 is positioned and fastened to the roof hatch base member 82 in the same manner, except that pole 14 is attached to the left corner 92 of the roof hatch 84. That is, left-handed pole 14 is positioned on the left corner 92 of base member 82 of the roof or access hatch 84 so that the longitudinal leg 50 of the bracket 28 is positioned against the left side 94 of the base member 82 of the roof hatch 84 and the lateral leg 44 of the bracket 28 is positioned against the left front 96 of the base member 82 of roof hatch 84. (See FIG. 1.) Bolts 80*a*–80*f* are inserted into holes 76*a*–76*f* and are used to fasten the bracket 28 to the base member 82 of the roof hatch 84.

Figure 2A:
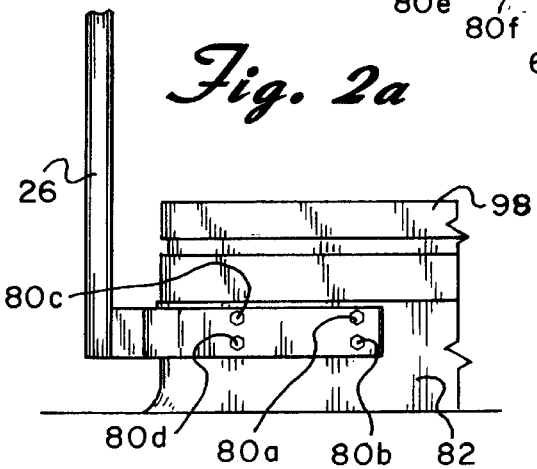
FIG. 2*a* is a partial side view of the left-handed pole of the present invention with the roof hatch in a closed position.

Vertical sections 18 and 26 of poles 12 and 14, respectively, are positioned on their respective brackets 20 and 28 so that the lid 98 of the roof hatch 84 has enough clearance to close, as seen in FIG. 2*a*. That is, in both of the embodiments the longitudinal legs of the poles are positioned on their respective brackets, either by being mounted on the extension flanges, as seen in the first embodiment, or by being mounted at the inside junctions of the lateral leg and longitudinal leg of the bracket, as seen in the second embodiment, so that the lid of the hatch has enough clearance.

The safety railing of the present invention not only affords protection for people accessing a roof, it is constructed in such a manner so as to meet OSHA requirements. For example, each of the handles of the poles extend up to 42 inches from the roof surface. Also, the poles are spaced approximately between 24–30 inches apart. That is, for larger roof or access hatches, the poles may be spaced closer together, as in the first embodiment, than for smaller hatches, as in the second embodiment. However, the distance between the two poles should not be less than 24 inches. That is, the poles of the railing in the first embodiment may be adjusted along the brackets in order to accommodate the roof hatch and to comply with OSHA requirements. The poles of the railing of the second embodiment, however, are affixed in the corners of the brackets in order to accommodate a smaller roof hatch.

Also, the railing surface is finished and the ends of the handles are covered or otherwise sealed so that no sharp or projecting edges are present, thereby preventing injury or torn clothing. Furthermore, the railing is capable of withstanding a force of at least 200 pounds applied within two inches of the top in any direction. While it is not an OSHA requirement, the railing may also be coated or painted yellow to further increase safety.

The present invention may be embodied in other specific forms without departing from the spirit or essential attributes thereof and accordingly, reference should be made to the appended claims rather than to the foregoing specification as indicating the scope of the invention.

I claim:

1. The combination of a roof access hatch and a safety railing for increasing a person's safety as the person climbs onto the horizontal support surface of a building comprising:

a roof access hatch having a base member, said base member being adapted to extend upwardly from said horizontal support surface and a safety railing including at least one pole extending upwardly from said base member of said roof access hatch.

2. The combination of an access hatch and a safety railing of claim 1 wherein said at least one pole includes a pair of poles including a right-handed pole and a left-handed pole.

3. The combination of an access hatch and a safety railing of claim 2 wherein said right-handed pole includes a handle, an elongated vertical section, and a bracket attached to said vertical section.

4. The combination of an access hatch and a safety railing of claim 2 wherein said bracket is attached to said base member.

5. The combination of an access hatch and a safety railing of claim 3 wherein said bracket includes at least two extension flanges joined together.

6. The combination of an access hatch and a safety railing of claim 5 wherein said pole is attached to said bracket where said extension flanges are joined together.

7. The combination of an access hatch and a safety railing of claim 3 wherein said bracket has a lateral leg with a bent end and a longitudinal leg with a bent end, said legs joined at said bent ends.

8. The combination of an access hatch and a safety railing of claim 3 wherein said bracket has a lateral leg with a curved end and a longitudinal leg with a curved end, said legs of said bracket forming a junction at said curved ends.

9. The combination of an access hatch and a safety railing of claim 8 wherein said vertical section of said pole is attached at said junction.

10. The combination of an access hatch and a safety railing of claim 2 wherein said left-handed pole includes a handle, an elongated vertical section, and a bracket attached to said vertical section.

11. The combination of an access hatch and a safety railing of claim 10 wherein said bracket includes at least two extension flanges joined together.

12. The combination of an access hatch and a safety railing of claim 11 wherein said pole is attached to said bracket where said extension flanges are joined together.

13. The combination of an access hatch and a safety railing of claim 10 wherein said bracket has a lateral leg with a curved end and a longitudinal leg with a curved end, said legs of said bracket forming a junction at said curved ends.

14. The combination of an access hatch and a safety railing of claim 13 wherein said vertical section of said pole is attached at said junction.

15. The combination of an access hatch and a safety railing of claim 10 wherein said bracket has a lateral leg with a bent end and a longitudinal leg with a bent end, said legs joined at said bent ends.

16. The combination of an access hatch and a safety railing of claim 10 wherein said bracket is attached to said base member.

* * * * *

US006167659C1

(12) EX PARTE REEXAMINATION CERTIFICATE (5306th)

United States Patent
Swindell, III

(10) Number: US 6,167,659 C1
(45) Certificate Issued: Mar. 21, 2006

(54) ROOF OR ACCESS HATCH SAFETY RAILING SYSTEM

(75) Inventor: Harold L. Swindell, III, Mt. Laurel, NJ (US)

(73) Assignee: Nesea Construction, Incorporated, Mt. Laurel, NJ (US)

Reexamination Request:
No. 90/006,401, Oct. 8, 2002

Reexamination Certificate for:

| | |
|---|---|
| Patent No.: | **6,167,659** |
| Issued: | **Jan. 2, 2001** |
| Appl. No.: | **09/243,869** |
| Filed: | **Feb. 3, 1999** |

(51) Int. Cl.
*E04B 7/18* (2006.01)

(52) U.S. Cl. ..... 52/20; 52/200; 182/106; 182/113

(58) Field of Classification Search ..... None
See application file for complete search history.

(56) References Cited

U.S. PATENT DOCUMENTS 2,137,751 A 11/1938 Davis ..... 108/1
3,016,238 A 1/1962 Malik ..... 268/102
5,502,934 A 4/1996 Coyne et al. ..... 52/200

OTHER PUBLICATIONS

Title 29 C.F.R. Section 1910.23; subsections (e)(iv) and (e)(v)(a) Revised Feb. 10, 1984.
Occupational Safety and Health Administration OSHA 3124 "Stairways and Ladders", Revised 1997.
"1996 Sweet's General Building & Renovation Catalog File" vol. 6 published 1996 by The McGraw Hill Companies, New York, NY 10020–1095. The pertinent reference is a Precision Stair Corp. brochure located at Section 07720 of the catalog.

*Primary Examiner*—Robert Canfield

(57) ABSTRACT

A roof hatch safety railing for increasing a person's safety as he or she climbs onto a roof or platform of a building from a roof or access hatch is disclosed. The safety railing includes two poles where one pole is attached to the right side of a roof hatch and the other pole is attached to the left side of the hatch. A person may grab the poles as he or she climbs from the roof or access hatch ladder, through the hatch, and onto the roof or platform. The poles are also spaced away from the hatch, thereby allowing enough clearance for a lid of the hatch to close and cover the hatch. The railing may be modified to accommodate various types and sizes of roof or access hatches.

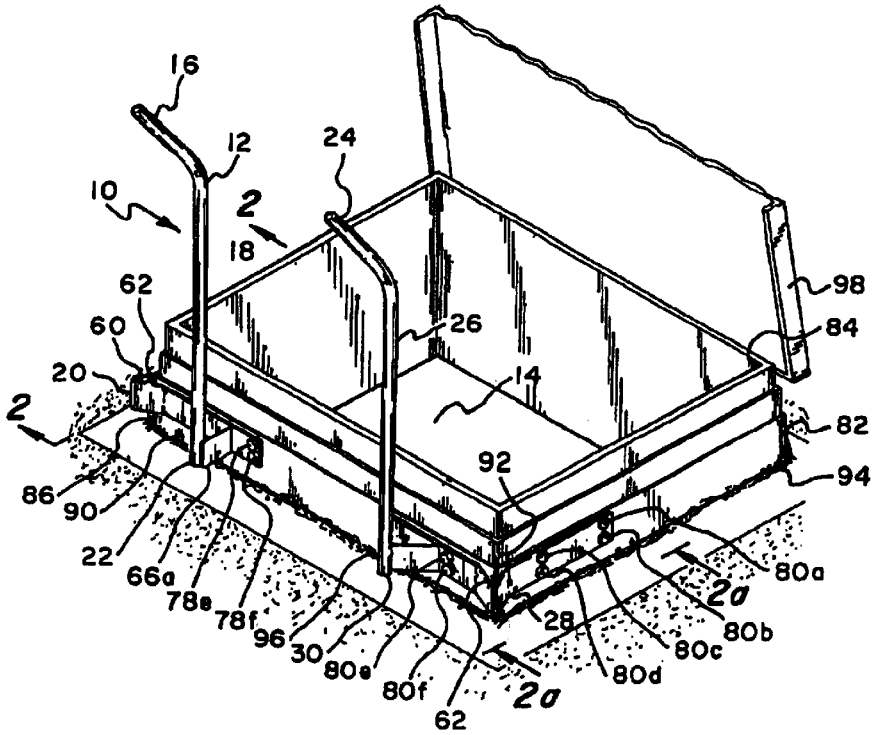

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 6–9 and 12–15 is confirmed.

Claims 1–5, 10, 11 and 16 are cancelled.

New claims 17–22 are added and determined to be patentable.

*17. The combination of a roof access hatch and a safety railing for increasing a person's safety as the person climbs onto the horizontal support surface of a building comprising:*

*a roof access hatch having a front, a left side and a right side and having a base member, said base member extending upwardly from said horizontal support surface and including a left corner and a right corner, and*

*a safety railing including at least left and right poles extending upwardly from said base member of said roof access hatch, said left pole being connected to said left side of said base member adjacent said left corner and said right pole being connected to said right side of said base member adjacent said right corner, said poles being spaced from each other by a distance of at least twenty four inches so as to allow a person to pass therebetween.*

*18. The combination of a roof access hatch and a safety railing of claim 17 wherein each of said poles includes a handle, an elongated vertical section, and a bracket attached to said vertical section.*

*19. The combination of a roof access hatch and a safety railing of claim 18 wherein said bracket is attached to said base member.*

*20. The combination of a roof access hatch and a safety railing of claim 17 wherein each of said poles extends to a height of approximately forty two inches above said horizontal support surface.*

*21. The combination of a roof access hatch and a safety railing of claim 20 wherein each of said poles is capable of withstanding a force of at least two hundred pounds in any direction applied within two inches of the top thereof.*

*22. The combination of a roof access hatch and a safety railing of claim 17 wherein said railing is yellow.*

* * * * *